US009791115B2

(12) United States Patent
Liang et al.

(10) Patent No.: US 9,791,115 B2
(45) Date of Patent: Oct. 17, 2017

(54) LED CEILING LAMP

(71) Applicants: UNILUMIN GROUP CO., LTD., Shenzhen (CN); Angeled Co., Ltd., Shenzhen (CN)

(72) Inventors: Youqing Liang, Shenzhen (CN); Zheng Xiao, Shenzhen (CN)

(73) Assignees: UNILUMIN GROUP CO., LTD., Shenzhen (CN); Angeled Co., Ltd., Shenzhen (CN)

( * ) Notice: Subject to any disclaimer, the term of this patent is extended or adjusted under 35 U.S.C. 154(b) by 0 days.

(21) Appl. No.: 14/733,087

(22) Filed: Jun. 8, 2015

(65) Prior Publication Data

US 2016/0116147 A1 Apr. 28, 2016

(30) Foreign Application Priority Data

Oct. 23, 2014 (CN) ..... 2014 2 0618430 U

(51) Int. Cl.

| | |
|---|---|
| ***F21V 23/02*** | (2006.01) |
| ***F21S 8/04*** | (2006.01) |
| *F21V 3/02* | (2006.01) |
| *F21Y 115/10* | (2016.01) |

(52) U.S. Cl.

CPC ..... *F21S 8/043* (2013.01); *F21V 23/023* (2013.01); *F21V 3/02* (2013.01); *F21Y 2115/10* (2016.08)

(58) Field of Classification Search

CPC ..... F21S 8/043; F21S 9/022; F21K 9/135; F21V 23/02; F21V 23/023

See application file for complete search history.

(56) References Cited

U.S. PATENT DOCUMENTS

| | | | | |
|---|---|---|---|---|
| 2010/0302758 | A1* | 12/2010 | Wang | F21S 9/022 362/20 |
| 2012/0161626 | A1* | 6/2012 | van de Ven | F21K 9/135 315/35 |
| 2014/0247603 | A1* | 9/2014 | Cruz | F21S 8/033 362/311.01 |

* cited by examiner

*Primary Examiner* — Karabi Guharay
(74) *Attorney, Agent, or Firm* — Kagan Binder, PLLC

(57) ABSTRACT

An LED ceiling lamp includes a base, a lampshade, an LED component, and a power supply assembly. The base includes a main body and a receiving box having an opening, the main body defines a through hole, an opening end of the receiving box disposes on an edge of the through hole on the main body. The lampshade is shielded on the base, the receiving box is received in a cavity enclosed by the lampshade and the base. The LED component is disposed on the base and received in the cavity. The power supply assembly is received in the receiving box and located outside the cavity, the receiving box defines a wire hole, the power supply assembly has a wire, the wire extends through the wire hole, the power supply assembly is electrically connected to the LED component through the wire.

11 Claims, 4 Drawing Sheets

LED CEILING LAMP

CROSS REFERENCE TO RELATED APPLICATIONS

This application claims priority under 35 U.S.C. §119(b) and 37 CFR 1.55 to Chinese application filed on Oct. 23, 2014 and having serial number 201420618430.5, wherein the entirety of said application is incorporated herein by reference.

FIELD OF THE INVENTION

The present invention relates to a field of LED lighting, and more particularly relates to an LED ceiling lamp.

BACKGROUND OF THE INVENTION

A ceiling lamp usually has a relative flat base, such that when installing the ceiling lamp, the base of the ceiling lamp can be completely attached to the ceiling. The light source of the ceiling lamp includes a common incandescent lamp, a fluorescent lamp, a high intensity gas-discharge lamp, and a halogen tungsten lamp, etc. Currently, the LED ceiling lamp is the most popular ceiling lamp, the LED ceiling lamp with a gorgeous appearance can be attached to or embedded in the ceiling of the roof, which becomes the main lighting equipment in the room.

With regarding to the conventional LED ceiling lamp, in order to achieve fireproofing, waterproofing, and explosion-proofing functions of the power supply, an independent power supply installing box is additionally provided for installing a power supply, however, the additional power supply installing box can cause a lot of problems, such as:

1. A large space is occupied;
2. The manufacturing cost and the material cost are high;
3. The stability of the overall structure cannot be ensured;
4. The power supply installing box will increase an installing difficulty of the LED ceiling lamp.

Thus, how to omit the power supply installing box under the premise of protecting the LED power supply is a research hotspot.

SUMMARY OF THE INVENTION

Accordingly, it is necessary to provide an LED ceiling lamp which has a compact structure, a high space using rate, a low cost, an integral firm construction, and facilitates to install.

An LED ceiling lamp includes:

a base including a main body and a receiving box having an opening, the main body defining a through hole, an opening end of the receiving box being disposed on the main body and connected to an edge of the through hole;

a lampshade shielding the base, the receiving box being received in a cavity enclosed by the lampshade and the base;

an LED component disposed on the base and received in the cavity; and a power supply assembly received in the receiving box and located outside the cavity, the receiving box defines a wire hole, the power supply assembly comprises a wire extending through the wire hole, and the power supply assembly is electrically connected to the LED component through the wire.

According to one embodiment, the LED component includes an annular lamp plate and an LED lamp positioned on the annular lamp plate, the annular lamp plate is sleeved on the receiving box.

According to one embodiment, the receiving box is shaped as a hollow truncated cone.

According to one embodiment, the LED ceiling lamp further includes a protecting cover disposed on the base, the LED component is disposed between the protecting cover and the base.

According to one embodiment, the protecting cover has an annular shape and is sleeved on the receiving box.

According to one embodiment, the power supply assembly is a non-isolated power supply.

According to one embodiment, an outer edge of the main body extends and is bent to form a flanging, the flanging latches with an edge of the lampshade.

According to one embodiment, the base is made of metal.

According to one embodiment, the base has a thickness greater than 0.5 millimeters.

According to one embodiment, the base defines an installing hole, the base is installed on a ceiling through the installing hole.

The receiving box of the base of the LED ceiling lamp can receive the power supply assembly directly. Compared to the conventional LED ceiling lamp, in which an extra power supply installing box is disposed on the base, the LED ceiling lamp can save the space, reduce the manufacturing cost and the material cost and enhance the stability of the overall structure, and reduce an installing difficulty of the LED ceiling lamp.

DETAILED DESCRIPTION OF THE EMBODIMENTS

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number in this Detailed Description section also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
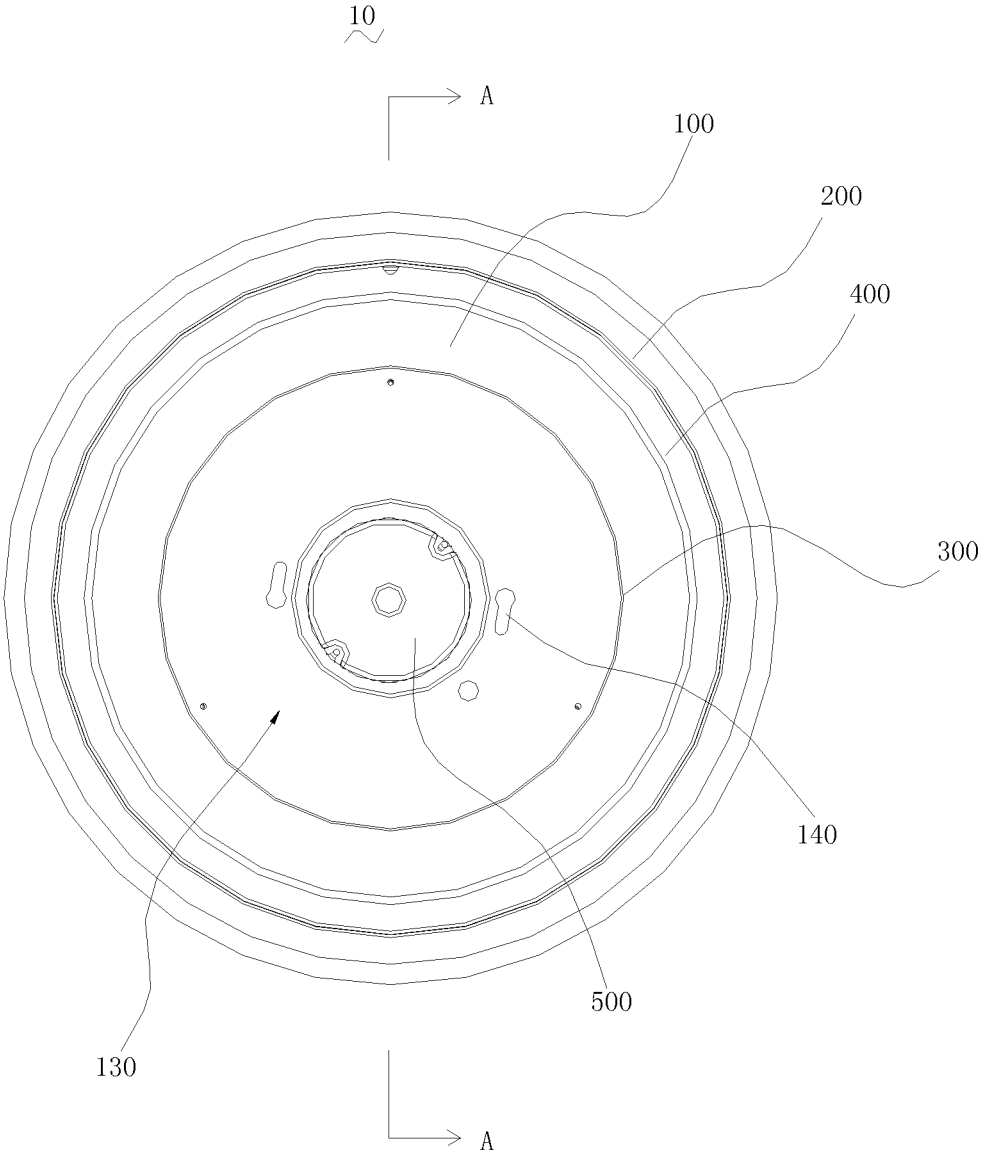
FIG. 1 is a top plan view of an LED ceiling lamp according to an embodiment.
Figure 2:
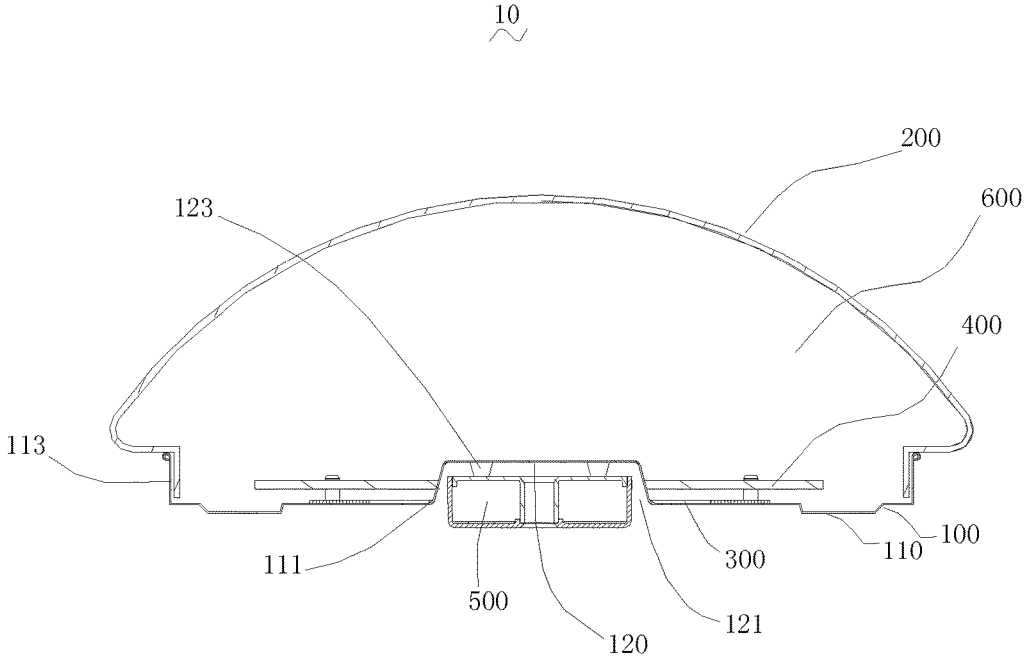
FIG. 2 is a cross sectional view taken along line A-A of FIG. 1.
Figure 3:
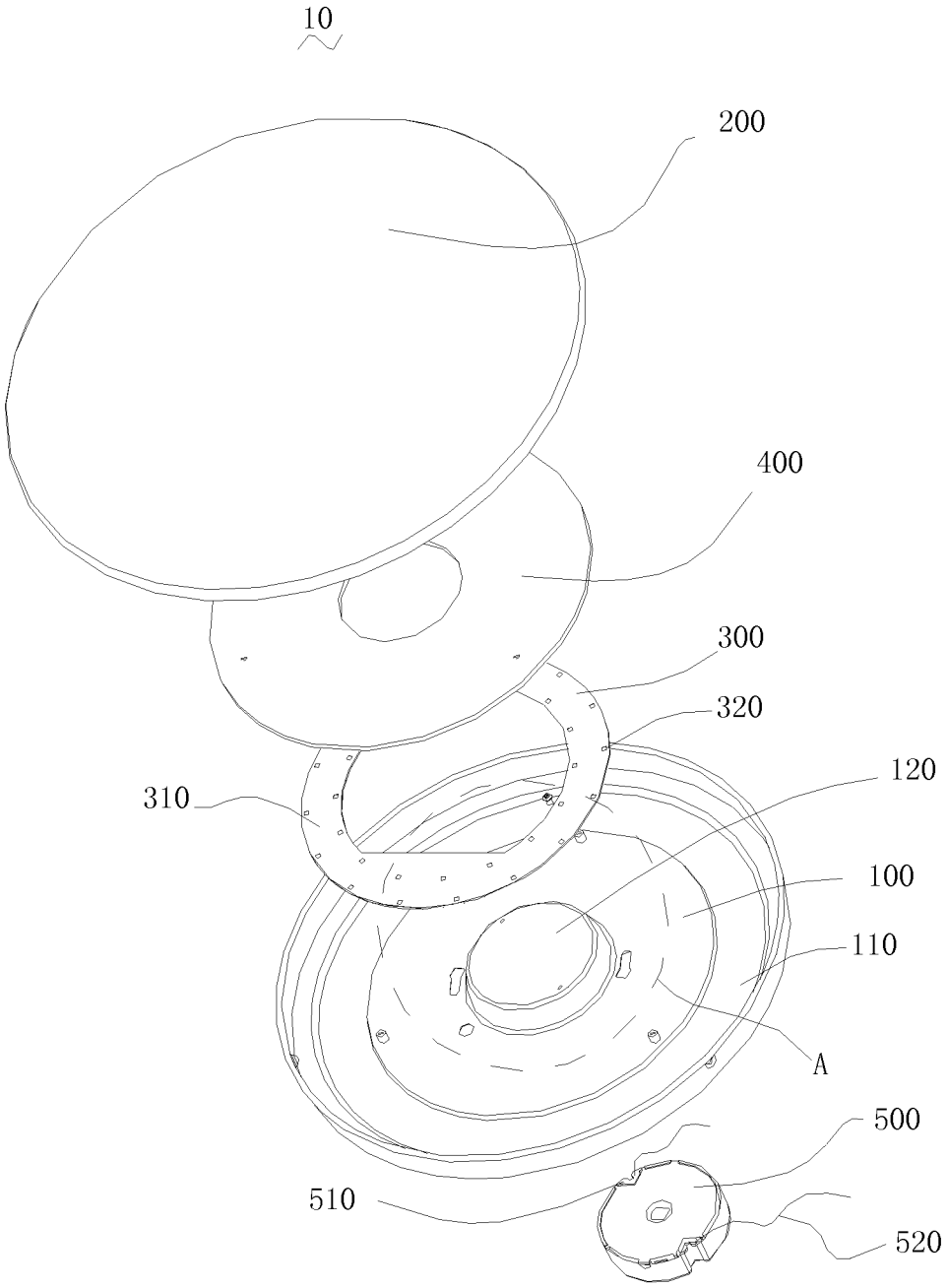
FIG. 3 is an explosive view of the LED ceiling lamp of FIG. 1.

Referring to FIGS. 1 through 3, an LED ceiling lamp 10 includes a base 100, a lampshade 200, an LED component 300, a protecting cover 400, and a power supply assembly 500. The lampshade 200, the protecting cover 400 and the LED component 300 are disposed on one side of the base 100, the power supply assembly 500 is disposed on the other side of the base 100.

Referring to FIG. 3, the base 100 includes a main body 110 and a receiving box 120 connected to the main body 110. Also referring to FIG. 2, the receiving box 120 defines an opening 121, i.e. the receiving box 120 is a hollow structure having an opening end. The main body 110 defines a through hole 111, the opening end of the receiving box 120 is disposed on the main body 110 and connected to an edge of the through hole 111. Also referring to FIG. 4, the receiving box 120 defines a wire hole 124, the wire hole 124 is used to electrically connect the power supply assembly 500 with the LED component 300. The power supply assembly 500 and the LED component 300 are located on opposite sides of the base 100. For example, the receiving box 120 is shaped as a hollow truncated cone. Or the receiving box 120 is a hollow cylinder. Or the receiving box 120 is a hollow cuboid.

In order to enhance a mechanical strength of the base 100, in one embodiment, the main body 110 and the receiving box 120 are integrally punch-formed. In another embodiment, the main body 110 and the receiving box 120 are integrally cast-formed. In yet another embodiment, the main body 110 and the receiving box 120 are integrally die cast-formed. In still yet another embodiment, the receiving box 120 is formed by protruding the main body 110 to one side, which can enhance the mechanical strength of the base 100.

In order to enhance a heat dissipation effect of the base 100, in one embodiment, the base 100 is made of metal, in another embodiment, the base 100 is made of aluminum alloy, which can enhance the heat dissipation of the base 100. The base 100 has a thickness greater than 0.5 millimeters, which can ensure a high mechanical strength and a good heat dissipation effect of the base 100.

In order to make sure that the base 100 is securely installed on the ceiling, referring to FIG. 1, the base 100 defines a pair of installing hole 140, the base 100 is installed on the ceiling through the installing hole 140. In one embodiment, a threaded fastener is extended through the installing hole 140 and installed on the ceiling. The base 100 can be better installed on the ceiling through the installing hole.

Referring to FIG. 2, the lampshade 200 is shielded on the main body 110, the lampshade 200 and the base 100 form a cavity 600, the receiving box 120 is received in the cavity 600 enclosed by the lampshade 200 and the base 100.

In order to make sure that the lampshade 200 is securely installed on the base 100, referring to FIG. 2, an outer edge of the main body 110 of the base 100 is extended and bended to form a flanging 113. The flanging 113 of the main body 110 latches with an edge of the lampshade 200. Thus, the lampshade 200 can be securely installed on the base 100, which is conductive to installing and dismantling.

Referring to FIG. 3, the LED component 300 is disposed on the base 100 and received in the cavity 600 enclosed by the lampshade 200 and the base 100.

Figure 4:
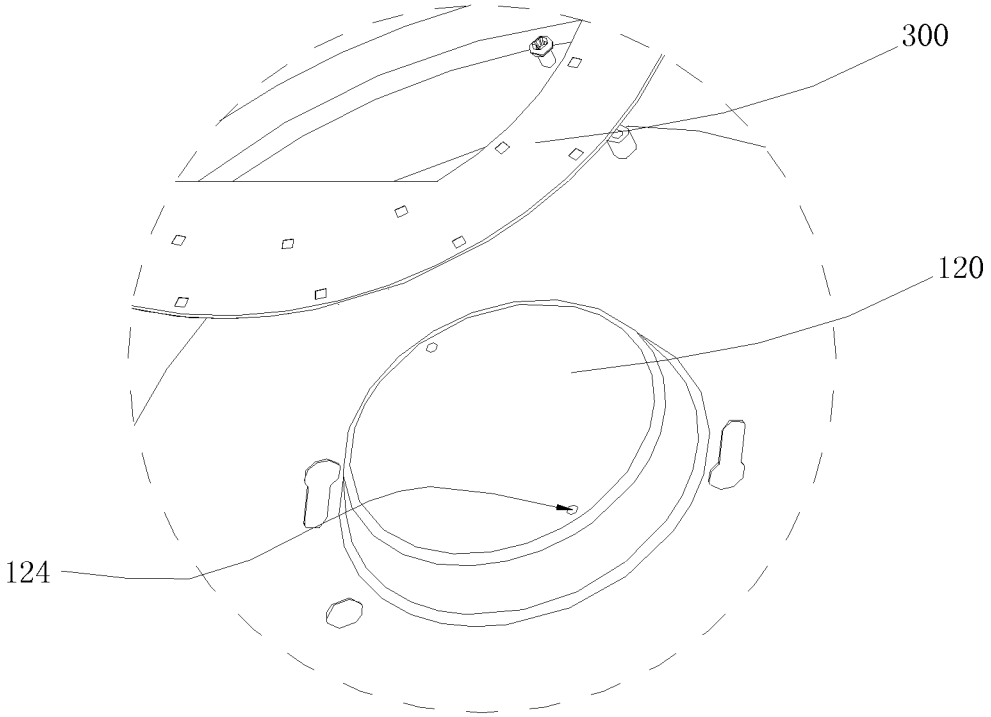
FIG. 4 is an enlarged view of the portion A of FIG. 3.

In order to effectively save a space in the LED ceiling lamp 10, and make sure that an overall structure of the LED ceiling lamp 10 is more compact and the LED component 300 is securely installed on the base 100, referring to FIG. 4, the LED component 300 includes an annular lamp plate 310 and an LED lamp 320 disposed on the annular lamp plate 310. The annular lamp plate 310 is sleeved on the receiving box 120, the annular lamp plate 310 and the LED lamp 320 are received in the cavity enclosed by the lampshade 200 and the base 100, which can effectively save the space in the LED ceiling lamp 10, and make sure that the overall structure of the LED ceiling lamp 10 is more compact, meanwhile, the LED component 300 can be securely installed on the base 100.

Referring to FIG. 2 and FIG. 3, the protecting cover 400 is disposed on the base 100. The LED component 300 is located between the protecting cover 400 and the base 100. The protecting cover 400 is used to protect the LED component 300 when installing and dismantling the lampshade 200.

In order to make sure that the protecting cover 400 is securely installed on the base 100, referring to FIG. 2, the protecting cover 400 is an annular structure, the protecting cover 400 is sleeved on the receiving box 120, the annular lamp plate 310 is disposed between the protecting cover 400 and the main body 110, the protecting cover 400 is received in the cavity 600 enclosed by the lampshade 200 and the base 100. Thus the protecting cover 400 is securely installed on the base 100. In one embodiment, an outer diameter of the protecting cover 400 is greater than an outer diameter of the annular lamp plate 310, thus the LED component 300 is further protected. In one embodiment, the protecting cover 400 is a transparent protecting cover, which can be made of tempered glass, organic glass, toughened glass, or frosted glass etc.

Referring to FIG. 2 and FIG. 3, the power supply assembly 500 is received in the receiving box 120 and located outside the cavity 600 enclosed by the lampshade 200 and the base 100. Compared to a conventional LED ceiling lamp, which an extra power supply installing box is required to be disposed on the base 100, the receiving box 120 of the base 100 can receive the power supply assembly 500, which can save the space and reduce a manufacturing cost and a material cost, enhance a stability of the overall structure. Referring to FIG. 2, the base 100 has an installing surface 130 configured to install the base on the ceiling. As the receiving box 120 is away from the installing surface 130 of the base 100, thus the installing surface 130 is flat, which effectively reduces an installing difficulty of the LED ceiling lamp 10.

In order to make sure that the power supply assembly 500 is securely installed in the receiving box 120, a side surface of an inner wall of the receiving box 120 adjacent to the power supply assembly 500 is provided with a plurality of backing pads 123. One side surface of the power supply assembly 500 closely contacts with the plurality of backing pads 123. In addition to that, the backing pads 123 can further absorb a part of an extrusion force of the power supply assembly 500 exerted by the ceiling.

In one embodiment, the power supply assembly 500 is a non-isolated power supply, the non-isolated power supply has advantages of simple structure, small volume, low manufacturing cost, wide adjusting range of output voltage, high power supply efficiency. In addition, after the LED ceiling lamp 10 is installed, the non-isolated power supply is housed within an enclosed space formed by the receiving box and the ceiling, avoiding the non-isolated power supply from being exposed to the outside, thus the LED ceiling lamp 10 is safe, which can meet national safety standards.

In order to make sure that the power supply assembly 500 and the LED component 400 are better electrically connected, referring to FIG. 4, the power supply assembly 500 has a contact piece 510 and a wire 520, the receiving box 120 defines a wire hole 124. The wire 520 and the contact piece 510 are electrically connected, the wire 520 extends through the wire hole 124, the wire 520 and the LED component 300 are electrically connected, thus the power supply assembly 500 and the LED component 300 can be better electrically connected.

The receiving box 120 of the base 100 of the LED ceiling lamp 10 can receive the power supply assembly 500, compared to the conventional LED ceiling lamp, which an extra power supply installing box is required to be disposed on the base 100, the LED ceiling lamp 10 can save the space, reduce the manufacturing cost and the material cost and enhance the stability of the overall structure, and reduce an installing difficulty of the LED ceiling lamp.

In the LED ceiling lamp 10, the power supply assembly 500 is installed in the receiving box 120 of the base 100, safety test requirements can be met by employing the base 100, a testing cost thereof is reduced.

Although the present invention has been described with reference to the embodiments thereof and the best modes for carrying out the present invention, it is apparent to those skilled in the art that a variety of modifications and changes may be made without departing from the scope of the present invention, which is intended to be defined by the appended claims.

What is claimed is:

1. An LED ceiling lamp, comprising:

a base comprising:

a main body having a first side facing a lamp interior and a second side facing a lamp exterior; and a receiving box connected to the main body, wherein the receiving box comprises:

a receiving box base; and a continuous side wall having a first end and a second end, wherein the first end is connected to the receiving box base so as to define a receiving box interior, wherein the second end is connected to the main body to define an opening into the receiving box interior from the lamp exterior, and wherein both sides of the continuous side wall taper inward from the second end to the first end, a lampshade shielding the base to define a cavity enclosed by the lampshade and the base;

an LED component disposed on the base and received in the cavity;

a protecting cover disposed on the base, wherein the LED component is disposed between the protecting cover and the base, and wherein the protecting cover has an annular shape and is sleeved on and in contact with the receiving box so as to position the protecting cover on the receiving box;

a power supply assembly received in the interior of the receiving box and located outside the cavity in the lamp exterior, the receiving box defining a wire hole, the power supply assembly comprising a wire extending through the wire hole, and the power supply assembly being electrically connected to the LED component through the wire; and a plurality of backing pads disposed on the receiving box base, wherein the backing pads are in contact with the power supply assembly to secure the power supply assembly to the receiving box.

2. The LED ceiling lamp according to claim 1, wherein the LED component comprises an annular lamp plate and an LED lamp positioned on the annular lamp plate, the annular lamp plate is sleeved on the receiving box.

3. The LED ceiling lamp according to claim 1, wherein the receiving box is shaped as a hollow truncated cone.

4. The LED ceiling lamp according to claim 1, wherein the power supply assembly is a non-isolated power supply.

5. The LED ceiling lamp according to claim 1, wherein an outer edge of the main body extends and is bent to form a flanging, the flanging latches with an edge of the lampshade.

6. The LED ceiling lamp according to claim 1, wherein the base is made of metal.

7. The LED ceiling lamp according to claim 6, wherein the base has a thickness greater than 0.5 millimeters.

8. The LED lamp according to claim 1, wherein the base defines an installing hole, the base is installed on a ceiling through the installing hole.

9. The LED lamp according to claim 1, wherein the main body comprises a through hole, and the opening end of the receiving box is disposed on the main body and connected to an edge of the through hole.

10. The LED lamp according to claim 1, wherein the main body and the receiving box are integrally punch-formed, integrally cast-formed, or integrally die cast-formed.

11. An LED ceiling lamp, comprising:

a base having a lamp interior side and a lamp exterior side; wherein the base comprises a receptacle housing for receiving the power supply assembly from the lamp exterior side, wherein the interior and exterior of the receptacle housing taper in a direction toward the lamp interior side;

a lampshade shielding the base to define a cavity enclosed by the lampshade and the base, wherein the receptacle housing protrudes into the cavity;

an LED component disposed on the base and received in the cavity, wherein the LED component comprises an annular lamp plate and an LED lamp positioned on the annular lamp plate, wherein the annular lamp plate is sleeved onto the receptacle housing;

a protecting cover disposed on the base, wherein the LED component is disposed between the protecting cover and the base wherein the protecting cover has an annular shape and is sleeved on and in contact with the receptacle housing so as to position the protecting cover on the receptacle housing;

a power supply assembly received in the receptacle and located outside the cavity in the lamp exterior side, the receptacle defining a wire hole, the power supply assembly comprising a wire extending through the wire hole, and the power supply assembly being electrically connected to the LED component through the wire; and a plurality of backing pads disposed in the receptacle housing so that the backing pads are in contact with the power supply assembly to secure the power supply assembly to the receptacle housing.

* * * * *